US011840951B1

(12) United States Patent
Reese, II

(10) Patent No.: US 11,840,951 B1
(45) Date of Patent: Dec. 12, 2023

(54) EXHAUST GAS BURNER ASSEMBLY

(71) Applicant: FCA US LLC, Auburn Hills, MI (US)

(72) Inventor: Ronald A Reese, II, Goodrich, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 18/065,215

(22) Filed: Dec. 13, 2022

(51) Int. Cl.
*F01N 3/20* (2006.01)

(52) U.S. Cl.
CPC ..... *F01N 3/2033* (2013.01); *F01N 2240/14* (2013.01); *F01N 2270/04* (2013.01); *F01N 2340/02* (2013.01); *F01N 2470/04* (2013.01); *F01N 2470/16* (2013.01); *F01N 2470/18* (2013.01); *F01N 2470/20* (2013.01); *F01N 2610/06* (2013.01); *F01N 2610/10* (2013.01)

(58) Field of Classification Search
CPC ..... F01N 3/2033; F01N 2340/02; F01N 2470/04; F01N 2470/16; F01N 2470/18; F01N 2470/20; F01N 2610/06; F01N 2610/10; F01N 2240/14; F01N 2270/04
See application file for complete search history.

(56) References Cited

U.S. PATENT DOCUMENTS 5,339,630 A 8/1994 Pettit
5,417,059 A * 5/1995 Hartel ..... F01N 3/025 60/303
10,344,646 B2 7/2019 Stanavich et al.
2011/0061374 A1* 3/2011 Noritake ..... F01N 3/36 60/303
2021/0372313 A1* 12/2021 Liu ..... F01N 9/00

FOREIGN PATENT DOCUMENTS

WO WO-2021139920 A1 * 7/2021 ..... F01N 3/025

OTHER PUBLICATIONS

Machine Translation of WO-2021139920-A1 (Year: 2021).*

* cited by examiner

*Primary Examiner* — Brandon D Lee
(74) *Attorney, Agent, or Firm* — Jeremy J. Klobucar

(57) ABSTRACT

An exhaust system for a vehicle having an internal combustion engine includes an exhaust pipe having a central axis and configured to receive an exhaust gas flow from the engine, a catalytic converter disposed within the exhaust pipe, and an exhaust gas burner assembly having a burner unit configured to generate and supply a heated burner flow to a supply pipe. An outlet end of the supply pipe is disposed within the exhaust pipe and extends substantially parallel to the exhaust pipe central axis such that the exhaust gas flows around the supply pipe outlet end. A plurality of mixing apertures are formed in the supply pipe outlet end and configured to promote mixing of the heated burner flow and the exhaust gas flow to disperse heat over the catalytic converter for rapid heating thereof.

11 Claims, 3 Drawing Sheets

EXHAUST GAS BURNER ASSEMBLY

FIELD

The present application relates generally to internal combustion engine exhaust systems and, more particularly, to an exhaust gas burner assembly for an exhaust system.

BACKGROUND

In conventional internal combustion aftertreatment systems it is difficult to achieve low tailpipe emissions in the time immediately following a cold engine start due to low catalyst conversion efficiency of cold catalysts. In order to achieve acceptable conversion efficiency, the catalyst must surpass a predetermined light-off temperature. As such, some vehicles include an additional heat source to promote faster heating of the catalyst to thereby quickly achieve optimal catalyst efficiency and reduce cold start emissions. However, known systems are often at the price of high exhaust system backpressure, durability, longevity, cost, and/or complexity. Thus, while such conventional systems do work well for their intended purpose, it is desirable to provide continuous improvement in the relevant art.

SUMMARY

According to one example aspect of the invention, an exhaust system for a vehicle having an internal combustion engine is provided. In one exemplary implementation, the exhaust system includes an exhaust pipe having a central axis and configured to receive an exhaust gas flow from the engine, a catalytic converter disposed within the exhaust pipe, and an exhaust gas burner assembly having a burner unit configured to generate and supply a heated burner flow to a supply pipe. An outlet end of the supply pipe is disposed within the exhaust pipe and extends substantially parallel to the exhaust pipe central axis such that the exhaust gas flows around the supply pipe outlet end. A plurality of mixing apertures are formed in the supply pipe outlet end and configured to promote mixing of the heated burner flow and the exhaust gas flow to disperse heat over the catalytic converter for rapid heating thereof.

In addition to the foregoing, the described exhaust system may include one or more of the following features: wherein the plurality of mixing apertures are arranged circumferentially around the supply pipe outlet end; wherein the plurality of apertures face in a direction substantially perpendicular to a direction of the exhaust gas flow as it flows over and around the outlet end; wherein the plurality of apertures face in a direction substantially perpendicular to the exhaust pipe central axis; wherein the exhaust pipe extends along the central axis upstream of the supply pipe outlet end; and wherein the burner unit is disposed outside of the exhaust pipe and the supply pipe extends through a wall in the exhaust pipe.

In addition to the foregoing, the described exhaust system may include one or more of the following features: wherein the supply pipe outlet end does not include louvers or fins for directing the exhaust gas flow and/or the heated burner flow; wherein the burner unit is configured to receive a flow of fuel from a fuel source, and a flow of air from an air source, wherein the flow of fuel is combusted to heat the flow of air and generate the heated burner flow; wherein each mixing aperture of the plurality of mixing apertures is circular; wherein each mixing aperture of the plurality of mixing apertures has a diameter of between approximately 5.0 mm and approximately 10 mm; and wherein the plurality of mixing apertures includes between only eight mixing apertures and between only twelve apertures.

In addition to the foregoing, the described exhaust system may include one or more of the following features: wherein the plurality of mixing apertures includes only eight mixing apertures each with a diameter of 10 mm; wherein the supply pipe outlet end is disposed between approximately 300 mm and approximately 500 mm from an upstream face of the catalytic converter; wherein the exhaust pipe and the supply pipe outlet end are coaxial; wherein the supply pipe is S-shaped; and wherein the exhaust pipe has an enlarged diameter in a location radially outward of the supply pipe outlet end.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Some conventional exhaust aftertreatment systems have limited or no capacity to get the catalyst to a light-off temperature for efficient conversion of harmful exhaust constituents before approximately fifteen seconds post cold start. Every second the engine is running and the catalyst is not at or above light-off temperature, CO, HC, and NOx are not being converted efficiently. As such, the short time preceding the catalyst light-off is responsible for a very large portion of the CO, HC, and NOx breakthrough for on and off cycle starts and long idles.

To address these potential issues, the present application is generally directed to a vehicle exhaust system having an exhaust gas burner assembly with improved exhaust gas mixing capability. The exhaust gas burner assembly is configured to heat the exhaust gas to rapidly warm the catalytic converter to its light-off temperature and hasten the conversion rate of harmful exhaust constituents. The exhaust burner assembly includes a mixing tube configured to disperse heat over the catalyst face to facilitate preventing a local hot spot. The mixing tube includes a plurality of circumferentially arranged holes to improve mixing and entrainment, reduce the length of a hot gas core, and allow the mixing tube to be located closer to the catalytic converter for higher heat transfer. As such, the exhaust system reduces heat losses and allows more heat to be transferred to the catalytic converter.

Figure 1:
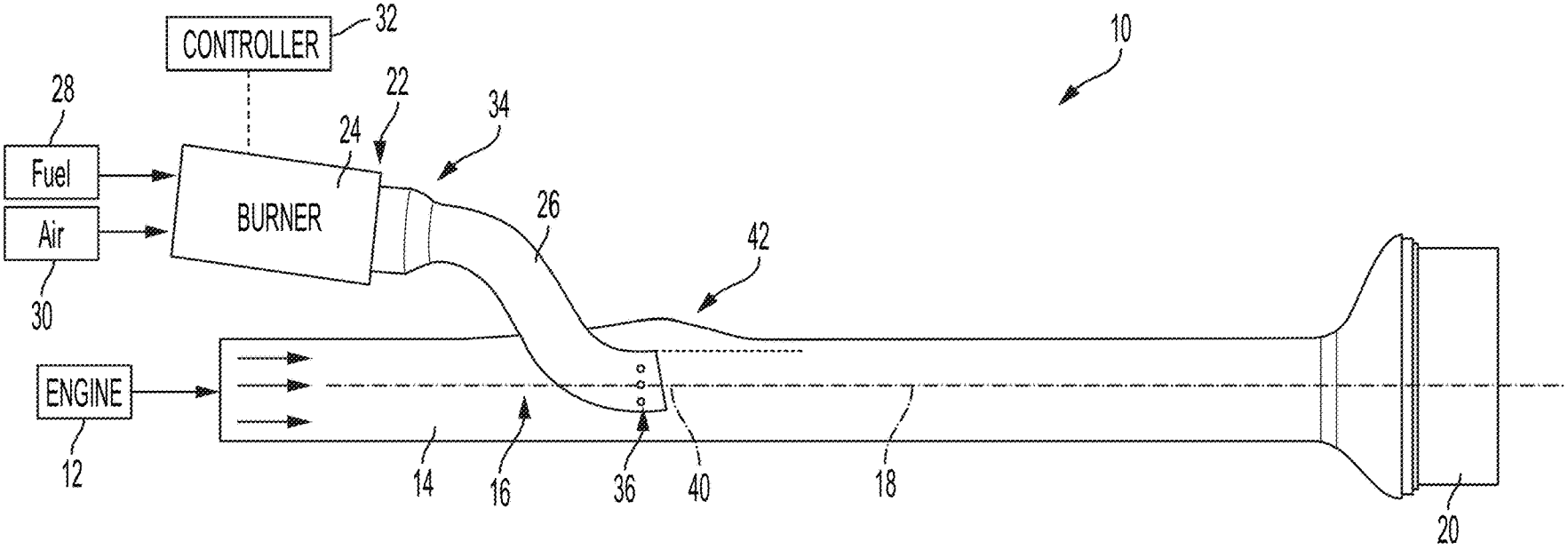
FIG. 1 is a cross-sectional view of a portion of a vehicle exhaust system in accordance with the principles of the present application.
Figure 2:
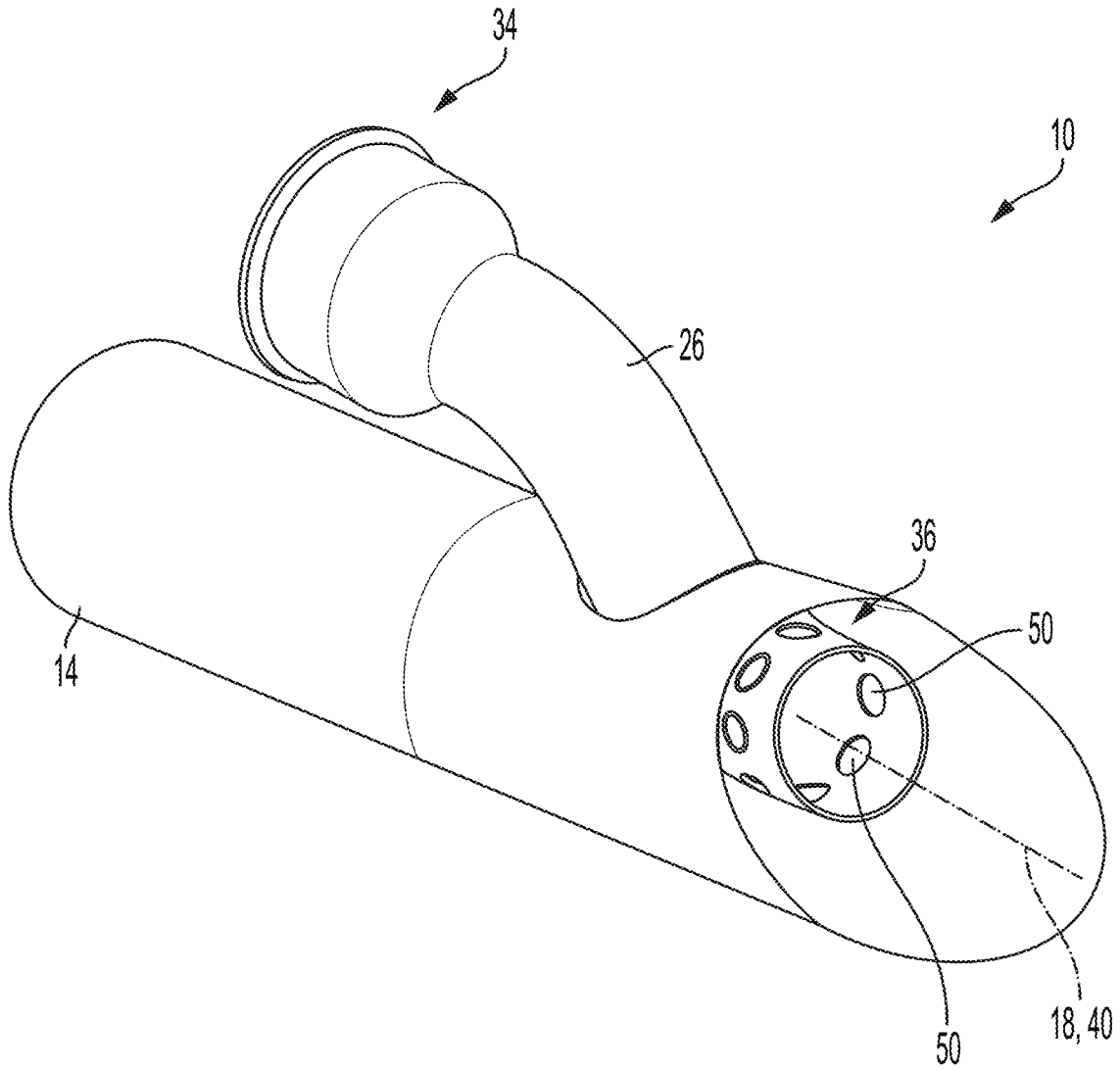
FIG. 2 is a sectional perspective view of the exhaust system of FIG. 1 illustrating an example exhaust gas burner assembly in accordance with the principles of the present application.

With initial reference to FIGS. 1 and 2, an example exhaust system for a vehicle is illustrated and generally identified at reference numeral 10. The exhaust system 10 is configured to receive and direct a flow of exhaust gas from an internal combustion engine 12 to an area outside of the vehicle. Additionally, the exhaust system 10 is configured to treat the exhaust gas to thereby reduce emissions of certain substances in the exhaust gas and help prevent their escape into the atmosphere.

In the example embodiment, the exhaust system 10 includes an exhaust pipe 14 configured to receive the exhaust gas from an exhaust manifold (not shown) in fluid communication with combustion chambers of the engine 12. The exhaust pipe 14 is hollow and cylindrical such that the exhaust gases can flow therethrough. However, it will be appreciated that exhaust pipe 14 can have any suitable shape and/or cross-sectional shape. As shown in FIG. 1, exhaust gas flows through a central region 16 of the exhaust pipe 14 in a direction generally along a central axis 18 thereof.

In the illustrated example, the exhaust system 10 further includes one or more catalytic converters 20 (only one shown) disposed downstream of an exhaust gas burner assembly 22. The catalytic converters 20 are configured to reduce or convert a desired exhaust gas constituent such as, for example, carbon monoxide (CO), hydrocarbon (HC), and/or nitrogen oxides (NOx). For example, the catalytic converter 20 can be a three-way conversion (TWC) catalyst and contains material that serves as a catalyst to reduce or oxidize the components of the exhaust gas into harmless gases.

The exhaust gas burner assembly 22 is located upstream of the catalytic converter 20 and is configured to generate a flow of heated air to mix with the exhaust gas flow and rapidly warm the catalytic converter 20. In the example embodiment, the exhaust gas burner assembly 22 generally includes a burner unit 24 and a supply pipe 26. As shown, the burner unit 24 is disposed outside of the exhaust pipe 14 and is configured to receive a flow of fuel from a fuel source 28 (e.g., a fuel rail), and a flow of air from an air source 30 (e.g., an air pump). A controller 32 (e.g., ECU) is in signal communication with the burner unit 24 and is configured to selectively activate the burner unit 24, for example, during a cold start, to thereby combust the fuel and generate a flow of heated air. Additionally, controller 32 can advantageously operate the burner unit 24 in engine-off conditions, for example, during a pre-start operation where the catalyst 20 is warmed by the burner assembly 22 for a predetermined amount of time prior to initiating engine ignition.

The heated air flow from the burner unit 24 is subsequently directed through a supply pipe inlet end 34, through the supply pipe 26, and finally through a supply pipe outlet end 36 and into the exhaust pipe 14. As shown, the supply pipe 26 extends through an aperture 38 formed in the exhaust pipe 14 and is coupled thereto, for example, via welding. In the example illustration, the supply pipe 26 is generally S-shaped, but may have any suitable shape that enables the exhaust gas burner assembly 22 to function as described herein. In the example embodiment, the supply pipe outlet end 36 is disposed within the exhaust pipe 14 in the central region 16 along the central axis 18. In this way, the supply pipe outlet end 36 is concentric with or substantially concentric with the exhaust pipe 14 so as to be centrally located therein. Further, a central axis 40 of the supply pipe outlet end 36 is parallel to or substantially parallel to the central axis 18, or even the same as or substantially the same as the central axis 18. Accordingly, the location and orientation of the supply pipe outlet 36 provides a co-axial flow arrangement of the exhaust gas flow and burner flow.

As previously described, the exhaust gas burner assembly 22 is configured to promote mixing of the burner flow and the exhaust gas flow. In some embodiments, the exhaust pipe 14 may have an enlarged cross-section 42 at or near a location radially outward of the supply pipe outlet 36 that is configured to reduce backpressure by adding flow area to compensate for area taken up by burner supply pipe 26.

In the illustrated example, the exhaust gas burner assembly 22 also includes a plurality of circumferentially arranged fluid mixing/entrainment apertures 50 formed at the supply pipe outlet end 36 to promote the mixing/entrainment of the burner flow and the exhaust gas flow. As shown, the circumferentially arranged mixing apertures 50 each face in a radial direction that is perpendicular to or substantially perpendicular to the exhaust gas flow. Such an orientation allows the burner flow in the supply pipe 26 to flow radially outward through the mixing apertures 50 against and/or into the exhaust gas flow, thereby promoting gas flow mixture. In other configurations, the exhaust gas flow is configured to flow radially inward through the mixing apertures 50 against and/or into the burner flow, thereby promoting gas flow mixture. Flow into or out of mixing apertures depends on the relative flow rates and/or local velocities of the exhaust gas flow and the burner flow.

Additionally, in the illustrated embodiment, the supply pipe 26 does not include any additional fluid directing features around the mixing apertures 50 such as louvers, fins, flaps, etc., thereby reducing cost and complexity. Moreover, by improving mixing, the burner assembly 22 can be moved closer to the catalytic converter 20 to reduce heat loss and transfer more heat to the catalytic converter 20, thereby providing quicker heating of the catalytic converter 20 to reduce emissions.

The mixing apertures 50 formed in supply pipe 26 may have any suitable shape and size to promote a desired type of mixing pattern (e.g., circular, oval, etc.). Further, while illustrated as arranged in a concentric fashion, mixing apertures 50 may be arranged in various other patterns such as, for example, two concentric arrangements of apertures in aligned or offset orientations. However, some example critical arrangements include: In one example, supply pipe 26 includes eight mixing apertures 50 having a diameter of 10 mm or approximately 10 mm. In another example, supply pipe 26 includes twelve apertures 50 each having a diameter of 5.0 mm or approximately 5.0 mm. In yet another example, supply pipe 26 includes eight apertures 50 each having a diameter of 8.0 mm or approximately 8.0 mm.

As noted above, the gas mixing promoted by burner assembly 22 allows the assembly to be moved closer to the catalytic converter 20. In the illustrated example, the supply pipe outlet 36 is arranged at a distance 'd' from the catalytic converter 20. In one example, the distance 'd' is between 300 mm and 500 mm, or between approximately 300 mm and approximately 500 mm. In another example, the distance 'd' is between 300 mm and 310 mm, or between approximately 300 mm and approximately 310 mm. In yet another example, the distance 'd' is between 400 mm and 410 mm, or between approximately 400 mm and approximately 410 mm. In yet another example, the distance 'd' is between 450 mm and 460 mm, or between approximately 450 mm and approximately 460 mm.

Figure 3:
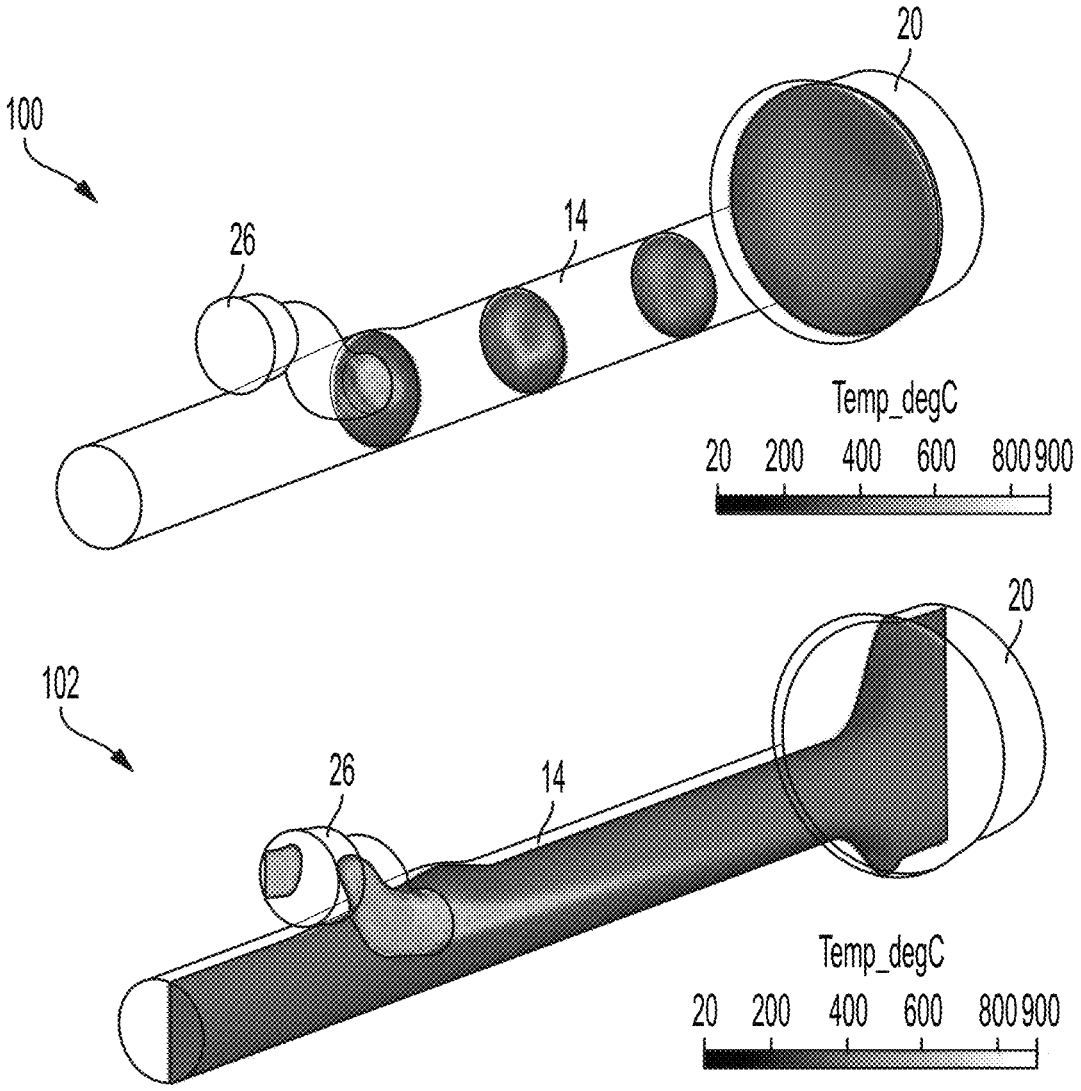
FIG. 3 illustrates example sectional heat maps of the vehicle exhaust system shown in FIG. 1, in accordance with the principles of the present application.

With additional reference to FIG. 3, example cross-sectional heat maps 100, 102 are provided illustrating the improved gas mixing of burner flow and exhaust gas flow promoted by the exhaust gas burner assembly 22. As shown, the exhaust gas burner assembly 22 effectively mixes/entrains the burner flow and exhaust gas flow to provide increased heating across the entire surface of the catalyst 20.

Described herein are systems and methods for a vehicle exhaust system having an exhaust gas burner assembly for rapidly heating a catalyst to its predetermined light-off temperature. The burner assembly includes a supply pipe with a plurality of mixing apertures to promote mixing of burner flow and exhaust gas flow to thereby disperse heat over the catalyst face and facilitate preventing a local hot spot. The mixing apertures improve mixing and entrainment, reduce the length of a hot gas core, and allow the mixing tube to be located closer to the catalytic converter for higher heat transfer. As such, the exhaust system reduces heat losses and allows more heat to be transferred to the catalytic converter.

It will be appreciated that the term "controller" as used herein refers to any suitable control device or set of multiple control devices that is/are configured to perform at least a portion of the techniques of the present application. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present application. The one or more processors could be either a single processor or two or more processors operating in a parallel or distributed architecture.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. An exhaust system for a vehicle having an internal combustion engine, the exhaust system comprising:

an exhaust pipe having a central axis and configured to receive an exhaust gas flow from the engine;

a catalytic converter disposed within the exhaust pipe; and an exhaust gas burner assembly having a burner unit configured to generate and supply a heated burner flow to a supply pipe, wherein an outlet end of the supply pipe is disposed within the exhaust pipe and extends substantially parallel to the exhaust pipe central axis such that the exhaust gas flows around the supply pipe outlet end, wherein a plurality of mixing apertures are formed in the supply pipe outlet end and configured to promote mixing of the heated burner flow and the exhaust gas flow to disperse heat over the catalytic converter for rapid heating thereof, wherein the exhaust pipe and the supply pipe outlet end are coaxial, wherein the plurality of mixing apertures face in a direction substantially perpendicular to a direction of the exhaust gas flow as it flows over and around the outlet end, wherein the burner unit is disposed outside of the exhaust pipe and the supply pipe extends through a wall in the exhaust pipe, wherein each mixing aperture of the plurality of mixing apertures has a diameter of between approximately 5.0 mm and approximately 10 mm, and wherein the plurality of mixing apertures includes between eight mixing apertures and twelve apertures.

2. The exhaust system of claim 1, wherein the exhaust pipe has an enlarged diameter in a location radially outward of the supply pipe outlet end.

3. The exhaust system of claim 1, wherein the plurality of mixing apertures are arranged circumferentially around the supply pipe outlet end.

4. The exhaust system of claim 1, wherein the plurality of apertures face in a direction substantially perpendicular to the exhaust pipe central axis.

5. The exhaust system of claim 4, wherein the exhaust pipe extends along the central axis upstream of the supply pipe outlet end.

6. The exhaust system of claim 1, wherein the supply pipe outlet end does not include louvers or fins for directing the exhaust gas flow and/or the heated burner flow.

7. The exhaust system of claim 1, wherein the burner unit is configured to receive a flow of fuel from a fuel source, and a flow of air from an air source, wherein the flow of fuel is combusted to heat the flow of air and generate the heated burner flow.

8. The exhaust system of claim 1, wherein each mixing aperture of the plurality of mixing apertures is circular.

9. The exhaust system of claim 8, wherein the plurality of mixing apertures includes only eight mixing apertures each with a diameter of 10 mm.

10. The exhaust system of claim 1, wherein the supply pipe outlet end is disposed between approximately 300 mm and approximately 500 mm from an upstream face of the catalytic converter.

11. The exhaust system of claim 1, wherein the supply pipe is S-shaped.

* * * * *